US005802658A

United States Patent [19]

Ward

[11] Patent Number: 5,802,658

[45] Date of Patent: Sep. 8, 1998

[54] PAINT AID AND/OR BRUSH

[75] Inventor: Keith Harold Ward, Surfdale, New Zealand

[73] Assignee: Tilt-A-Brush Limited, Surfdale, New Zealand

[21] Appl. No.: 608,248

[22] Filed: Feb. 28, 1996

[30] Foreign Application Priority Data

Feb. 28, 1995 [NZ] New Zealand ..... 270586

[51] Int. Cl.[6] ..... A46B 5/00

[52] U.S. Cl. ..... 15/144.2; 15/172

[58] Field of Search ..... 15/144.1–144.4, 15/172

[56] References Cited

U.S. PATENT DOCUMENTS

| | | | |
|---|---|---|---|
| 47,927 | 5/1865 | Burtnett et al. | 15/144.1 |
| 1,779,057 | 10/1930 | Tolmach | 15/144.2 |
| 2,395,245 | 2/1946 | Booharin | 15/144.2 |
| 2,680,868 | 6/1954 | Peterson | 15/144.2 |
| 3,596,304 | 8/1971 | Welt | 15/144.3 |
| 3,604,044 | 9/1971 | Johnson | 15/172 |
| 4,796,325 | 1/1989 | Bortman | 15/144.2 |
| 5,502,859 | 4/1996 | Kim | 15/144.1 |

FOREIGN PATENT DOCUMENTS

| | | | |
|---|---|---|---|
| 176596 | 7/1935 | Switzerland | 15/144.2 |

*Primary Examiner*—Terrence Till

*Attorney, Agent, or Firm*—Jacobson, Price, Holman & Stern, PLLC

[57] ABSTRACT

This invention provides a paint aid and/or a brush in which the brush head is connected to the handle by a pivotal connection allowing pivoting of the brush head with respect to the handle about at least a single axis. preferably, ball and socket type joint is used to allow rotation about at least two axes.

5 Claims, 6 Drawing Sheets

PAINT AID AND/OR BRUSH

BACKGROUND TO THE INVENTION (1) Field of the Invention

The present invention relates to a painting aid and/or a brush. Although particularly described with reference to a paint brush, the invention may also be applied to other brushes.

(2) Description of the Prior Art

One of the difficulties presently encountered by painters and home handy persons is the painting of out-of-reach places or hard-to-reach places. If a large area such as a ceiling needs to be painted, scaffolding will usually be erected. However, this necessitates several large pieces of equipment, and time for setting the scaffolding up. If a painter has just completed painting an out-of-reach area, or hard-to-reach area, such as a ceiling or shadow margin but then realises that an area has accidentally not been painted, the painter will usually have to unpack and re-erect the scaffolding and/or ladders.

OBJECT OF THE INVENTION

It is an object of the present invention to provide a painting aid and/or a brush which will go some way in overcoming these disadvantages or which will at least provide the public with a useful choice.

SUMMARY OF THE INVENTION

According to one aspect of the present invention, there is provided a paint aid device having an extension, a connector fitting, a mounting and a brush, wherein the mounting allows the brush to pivot through at least one plane relative to the extension and wherein the brush can be locked at a desired angle.

According to a second aspect, the invention consists in a paint aid device and/or brush comprising a handle; a brush head; and connection means between the brush head and the handle such that the brush head can pivot about at least one axis relative to the handle and wherein the brush head can be restrained from further rotation when a desired position has been reached.

BRIEF DESCRIPTION OF THE DRAWINGS

Further aspects of the invention will become apparent from the following description which is given by way of example with reference to the accompanying drawings in which.

DETAILED DESCRIPTION OF PREFERRED EMBODIMENTS

Figure 1:
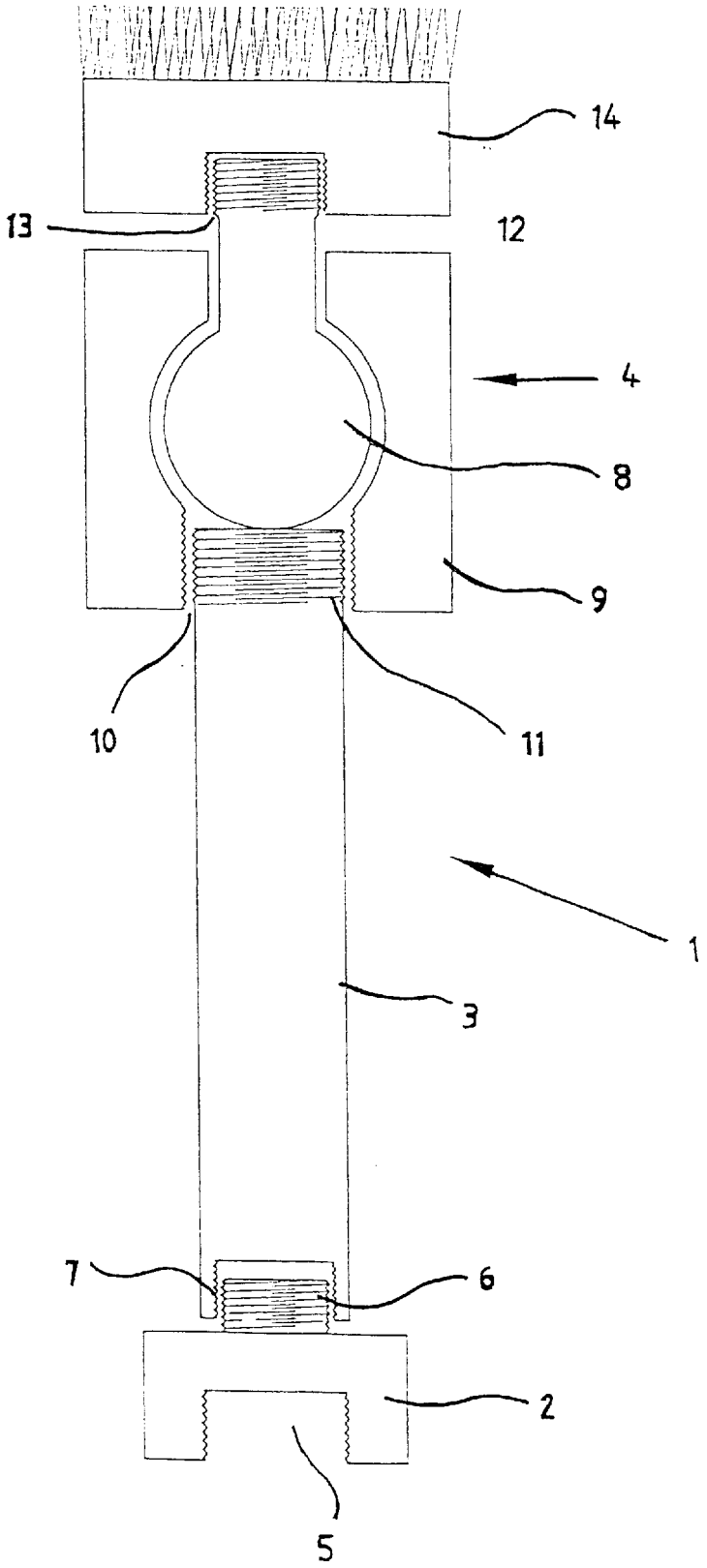
FIG. 1 shows a side view of a painting aid according to one embodiment of the present inventions.

The painting aid 1 comprises a connector fitting 2, an extension 3 and a mounting 4. The connector fitting 2 has a threaded recess 5, so the connector fitting 2 can fit onto a standard pole commonly used with paint rollers (not shown). The connector fitting 2 and extension 3 screw fit together by means of a threaded portion 6 on connector fitting 2 and a corresponding threaded recess 7 on extension 3.

The connector fitting may have a threaded recess so as to screw fit onto a pole usually used with paint rollers.

The mounting may incorporate a ball and socket joint, wherein the socket may screw onto a threaded region of the extension. A protrusion from the ball screw fits into a threaded recess in the brush. The ball, and consequently the brush, may be locked into position by screwing the socket onto the extension whilst the ball and brush are held in that position.

Alternatively, the mounting may comprise a connection, wherein one portion of the connection is threaded so as to screw into a threaded recess on the brush, and an other portion fits into a slot in the extension and is secured by a bolt and a wing nut, the bolt extending through holes in the extension and the other portion of the connection. The bolt may be substantially perpendicular to the extension.

Alternatively the mounting may comprise a circular fitting attached to the extension by a pin screw or the like, so that the circular fitting can rotate about the pin, screw or the like, and can be locked at a desired angle by tightening the pin, screw or the like. The circular fitting may have a screw threaded pipe which fits into a threaded recess in the brush.

The brush may be a 38 mm, 50 mm, 63 mm, 75 mm or 100 mm brush.

The extension and the connector fitting may be cylindrical or shaped to fit the hand.

The extension, connector fitting and mounting may be constructed from any suitable material, such as aluminium, a metal alloy, a plastics material (such as nylon) or reinforced plastics material.

In the embodiment of the invention shown in FIG. 1, the mounting 4 incorporates a ball and socket joint. The ball 8 is held in place by the top of the extension 3. The socket 9 is formed in the mounting 4. An upper threaded portion 11 of the extension 3 is screwed into a threaded recess 10 in mounting 4. A protrusion 12 screws into a threaded recess 13 in a brush 14.

Figure 2:
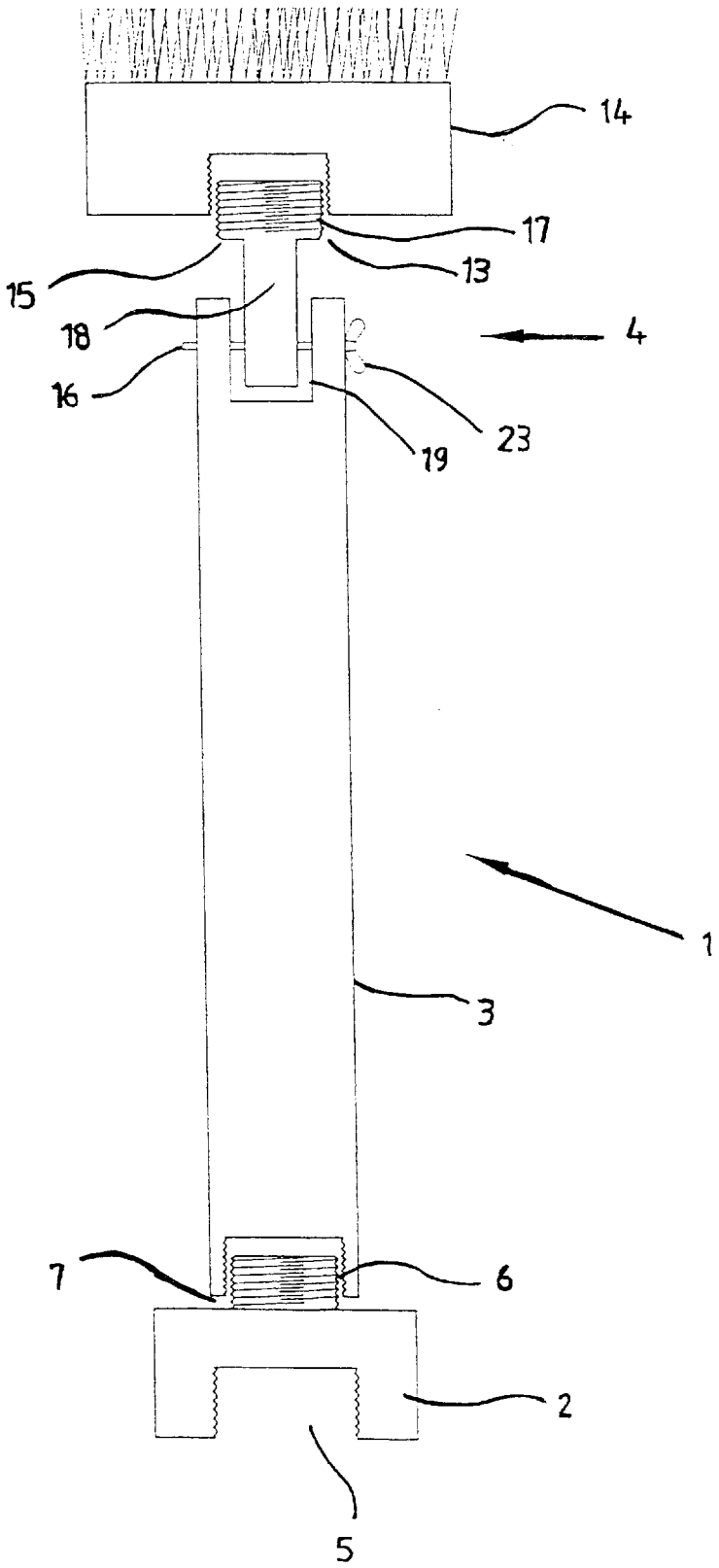
FIG. 2 shows a side view of a painting aid according to another embodiment of the present invention.

In the embodiment of the invention shown in FIG. 2, the mounting 4 comprises of connection 15, a bolt 16 and a wing nut 23. The connection 15 comprises an upper portion 17, which is threaded so as to screw fit with the threaded recess 13 in brush 14. The lower portion 18 fits into a slot 19 in an extension 3. The bolt 16 which extends through holes (not shown) in the extension 3 and lower portion 18, secures the lower portion 18 in the desired position, with the wing nut 23.

Figure 3:
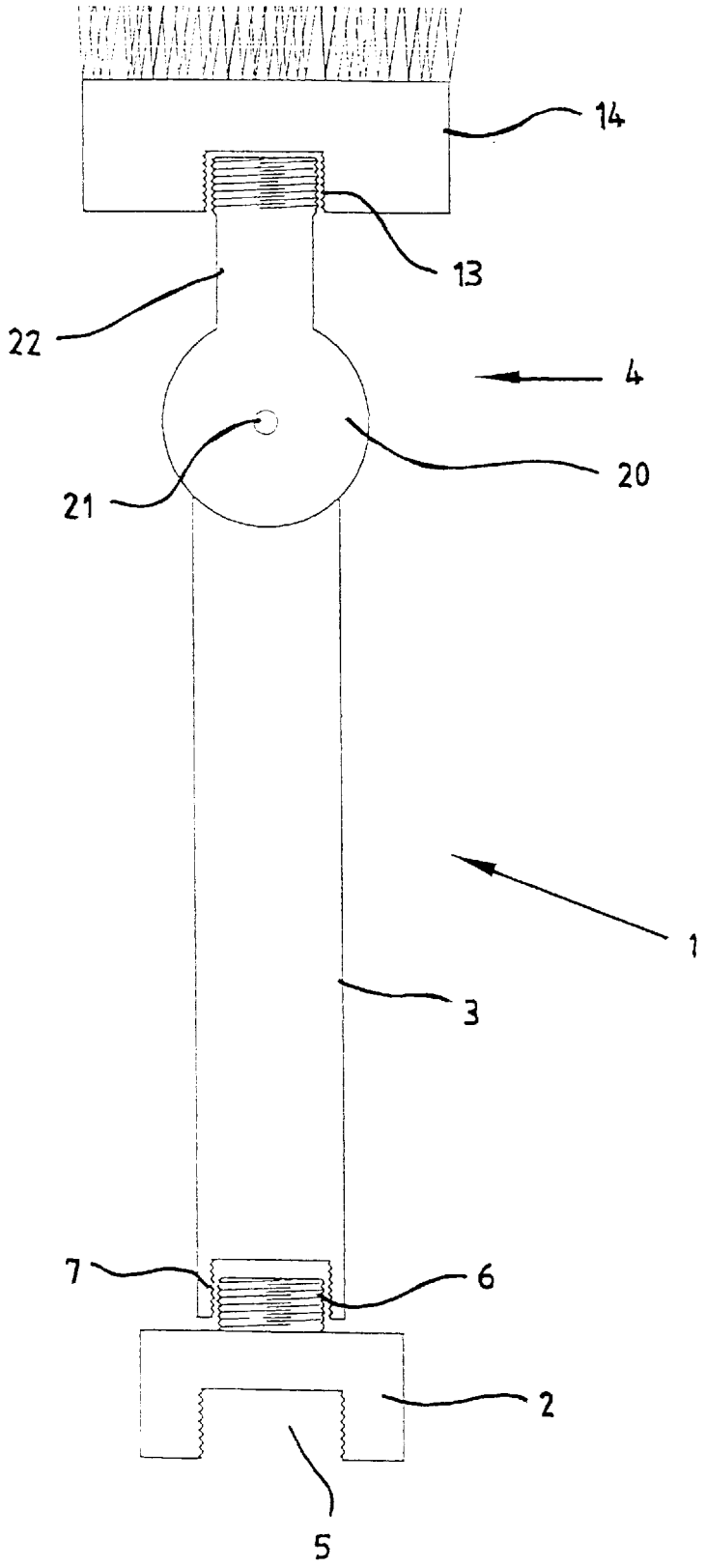
FIG. 3 shows a side view of a painting aid according to yet another embodiment of the present invention.
Figure 4:
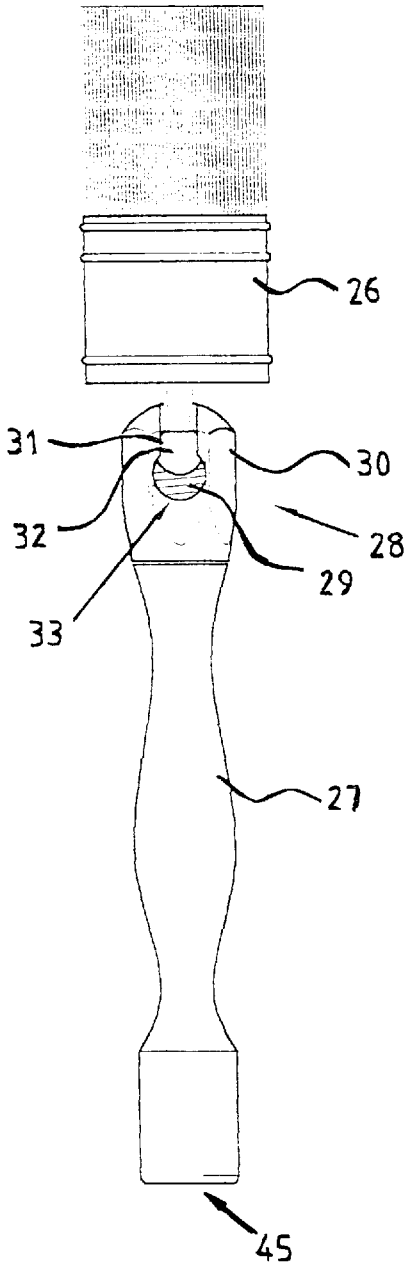
FIG. 4 shows a front elevational view of a further embodiment of the invention.
Figure 5:
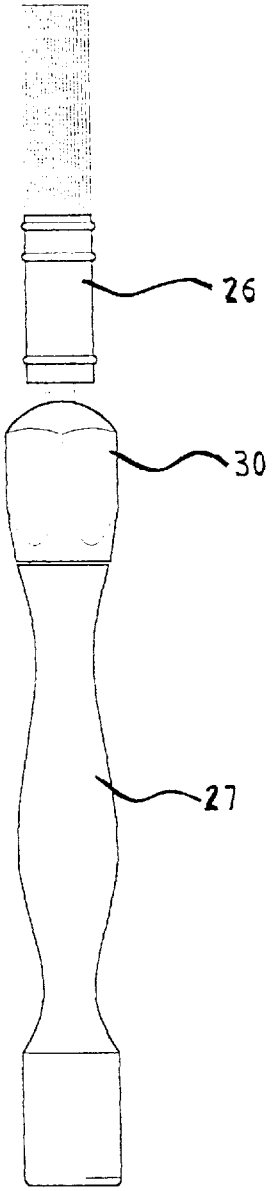
FIG. 5 shows a side elevation of the embodiment of FIG. 4.

In the embodiment of the invention shown in FIG. 3, a circular fitting 20 is attached to extension 3 by means of a bolt and wing nut or the like 21, in such a way that the circular fitting can rotate about the bolt and wing nut or the like, and can be locked in a desired position by tightening the bolt and wing nut or the like. A screw threaded pipe 22 extends from the circular fitting 20 and fits into the threaded recess 13 in brush 14.

The materials from which this device is constructed are preferably aluminium, a metal alloy, a plastics material (such as nylon) or reinforced plastics material.

A further embodiment of the invention is shown in FIGS. 4, 5, 6 and 7. In this embodiment the invention provides a brush head 26 connectable to a handle 27. The handle may be provided in the form of an extended handle for reaching inaccessible places or may just be of normal length and yet providing the facility for the brush head 26 to be rotated with respect to the handle 27 into a variety of positions for ease of use.

The connection between the brush 26 and handle 27 is again provided as a ball and socket type joint. The handle 27 may have a threaded portion 29 which threads into a head portion 30 containing a socket recess 31. A ball joint 32 attached to the brush head 26 may be pushed into the socket 31 as the handle 27 is threaded into the head 30 by an upward face of the threaded portion 29.

Once the handle 27 is substantially fully threaded into the head 30, the ball joint 32 may be jammed against an upper side of the socket 31 to lock the ball and socket joint in the position as provided.

In this particular embodiment, the brush head 26 may be threaded onto the ball joint 32 to allow interchange of brush heads 26. However, in a further embodiment and as currently preferred, the ball joint 32 may be provided as a permanent part of the brush head 26. To interchange the brush heads, the unthreading of the handle 27 may allow sufficient freedom for the ball joint 32 to drop lower in the socket 31 and exit from the socket through a suitable opening provided in the side of the head portion 30, being opening 33.

If desired, the handle 27 can be replaced by a longer extended handle, or more preferably, the end 45 may be threaded to connect to an extended handle.

Figure 6:
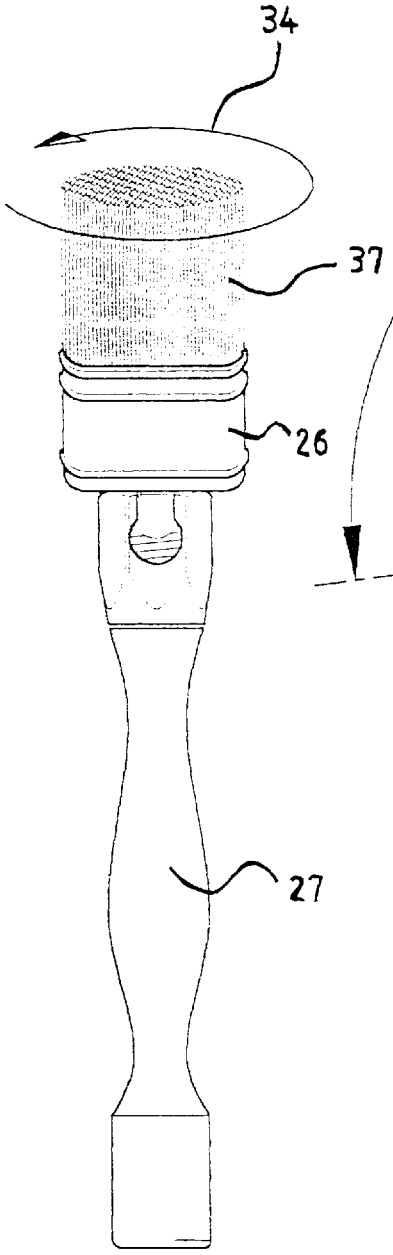
FIG. 6 shows a front elevation of the embodiment of FIG. 4 when in a further configuration.
Figure 7:
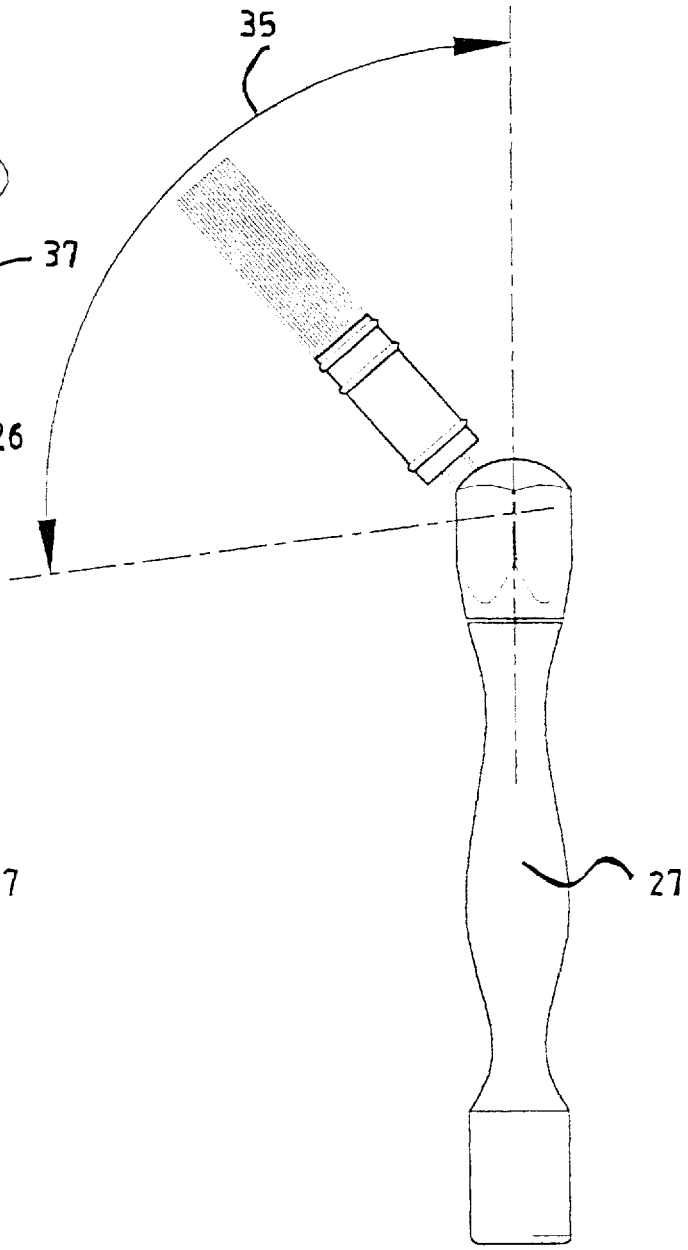
FIG. 7 shows the side elevation of the embodiment of FIG. 4 when in a further configuration.

It can be seen from the arrows 34 and 35 in FIGS. 6 and 7 respectively that the ball and socket type joint allows two separate rotational movements of the brush head 26 with respect to the handle 27. As can be seen in FIG. 6, the brush head can be rotated about an axis substantially parallel to the bristles 37 to allow the brush head to present the narrow or wide face of the brush as may be required at different times.

FIG. 7 and the arrow 35 shows the degree of freedom available to the brush head through the ball and socket type joint which allows the brush head to be rotated such that the bristles 37 are off axis from the substantially longitudinal axis of the handle 27. This provision of a brush which allows rotation of the brush head with respect to the handle about two substantially orthogonal axes allows the brush to provide configurations which may allow easier brush strokes even without providing an extension to the handle.

Figure 8:
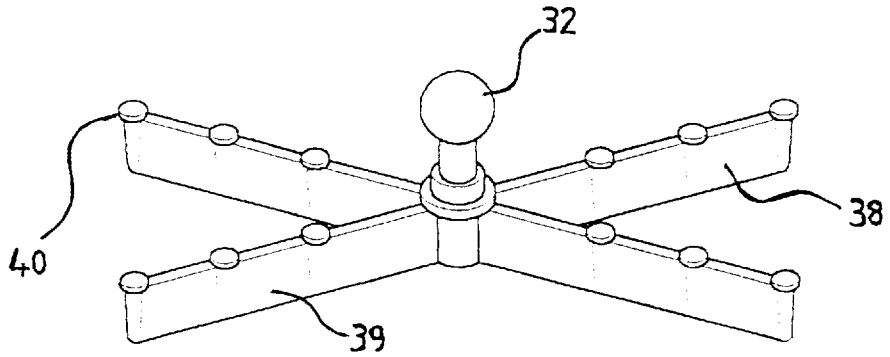
FIG. 8 shows an embodiment of a connector used as part of a preferred embodiment of the invention.
Figure 9:
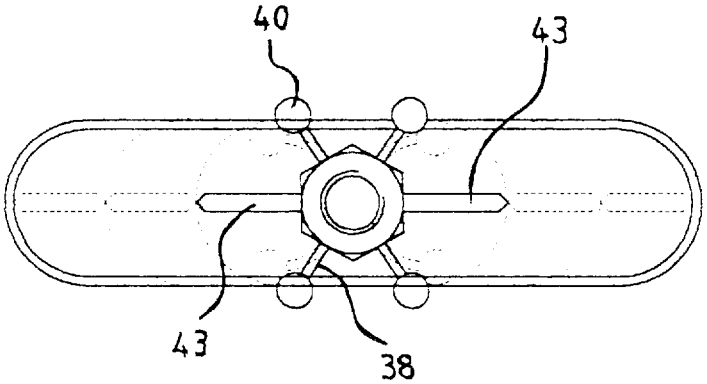
FIG. 9 shows a plan view of a connector element in use in accordance with a further embodiment of the invention.
Figure 10:
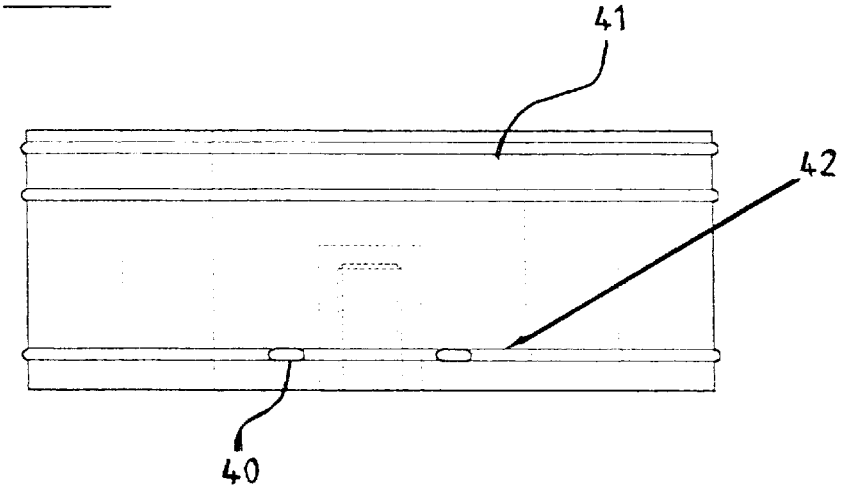
FIG. 10 is an elevational view of the apparatus of FIG. 9.

FIG. 8 shows a connector 38 which may be permanently attached or, if preferred, detachable from the ball joint 32. The connector 38 is provided with location means such as arms 39 and having engagement means 40 to locate within and engage with the metal ferrule band provided around the conventional brush head. It can be seen that a plurality of the engagement means 40 are provided along the length of each of the arms 39 and these are provided so that the arms 39 can be cut off to an appropriate length for the size of ferrule band 41 that the connector 38 may be used with. An example of such a connection is shown in FIG. 9 and FIG. 10 shows an elevational view of the ferrule band provided around many conventional brush heads. They are generally of uniform sizes to meet the uniform size of the brush and the engagement means 40 may simply nest within grooves 42 which are provided in the conventional ferrule bands 41. This may allow the apparatus to be located in the ferrule band and centrally located while the remainder of the ferrule band is filled with epoxy or plastics material or some similar such material to set the ball joint 32 permanently into the ferrule band.

An alternative to the connector 38 is shown in FIG. 9. In this example, the arms 38 may be provided of constant length to provide the engagement means 40 into the grooves. This is suitable for some brushes in which the long axis of the ferrule band may vary according to brush size, however, the short axis across the brush is of constant size. To centrally locate the connector 38, arms 43 may be provided as shown which extend along the long axis of the ferrule band. Again, these arms 43 may have weakened points to allow portions to be easily broken or cut off the arms 43 to provide an arm of the appropriate length for the particular size of ferrule band being used.

Thus it can be seen that the brush provides a brush head 26 which may be orientated in a variety of different positions with respect to the handle 27. Although generally shown as being rotatable through an arc 35 as shown in FIG. 7 of some 90°, this could be greater if required. It is over to the particular type of pivotal connection provided between the brush head 26 and handle 27 as to the exact nature of the connection. However, in this preferred form, rotation about substantially two axis would appear to provide some advantages.

It will thus be seen that the present invention provides a device for aiding painting, however, the invention may be applied and used in conjunction with further brush types.

Where in the foregoing description, reference has been made to integers or components having known equivalents, then such equivalents are herein incorporated as if individually set forth.

Although this invention has been described by way of example and with reference to possible embodiments thereof, it is to be appreciated that improvements or modifications may be made thereto without departing from the scope or spirit of the invention.

What I claim is:

1. A paint aid device comprising a handle;

a brush head;

connection means between said brush head and said handle;

a ball configuration fixed to said brush head and forming part of said connection means;

a socket to receive said ball configuration within an intermediate member between said brush head and said handle;

a threaded portion within said intermediate member to receive a corresponding threaded portion of said handle within said intermediate member such that said handle can be threaded to apply pressure to a ball of said ball configuration in said socket at a distal end of said intermediate member and thereby lock said ball in place within said socket; and said intermediate portion having an opening in a wall of said socket portion to accommodate a connecting portion of said ball configuration and allow rotation of said brush head by movement of said connecting portion through said opening;

said opening in said socket portion terminating in at least one end at a side of said wall and being large enough to allow passage of said ball configuration to enable said brush head to be disconnected from said handle when said handle is unthreaded to no longer apply pressure to said ball configuration within said socket.

2. A paint aid device as claimed in claim 1, wherein said connecting portion between said brush head and said ball configuration is fixed within a ferrule of said brush head at a distal end from said ball configuration.

3. A paint aid device as claimed in claim 1, wherein said connection means is formed integrally with said brush head.

4. A paint aid device as claimed in claim 1, wherein said connection means has an opposite threaded end from said ball configuration, said threaded end connecting with a threaded portion of said brush head.

5. A paint aid device as claimed in claim 1, wherein movement of said connecting portion through said opening allows said brush head to be moved through substantially 90 degrees to be substantially orthogonal to a longitudinal axis of said handle.

* * * * *